United States Patent [19]

O'Larey

[11] Patent Number: 4,646,364

[45] Date of Patent: Mar. 3, 1987

[54] PACKAGED DISPOSABLE CHEMICAL CAPES

[76] Inventor: Polly A. O'Larey, 105 Taylor Dr., Okmulgee, Okla. 74447

[21] Appl. No.: 788,851

[22] Filed: Oct. 18, 1985

[51] Int. Cl.[4] ..... A41B 13/10

[52] U.S. Cl. ..... 2/49 R

[58] Field of Search ..... 2/49 R

[56] References Cited

U.S. PATENT DOCUMENTS 3,001,646 9/1961 Cooper ..... 2/49 R 3,146,464 9/1964 Burnett ..... 2/49 R

*Primary Examiner*—Doris L. Troutman

*Attorney, Agent, or Firm*—Head, Johnson & Stevenson

[57] ABSTRACT

A disposable cape particularly for hairdressing salons, beauty shops and the like. The capes are manufactured in a continuous long strip of a flexible material which is resistent to chemicals normally used in a beauty salon such as polyethlene or polyvinylchloride. This long strip is provided with a large number of perforated rows which are perpendicular to the edges of the strip and divides the strip into a large number of capes. The distance between the perforated rows is the length of the cape and the width of the strip is the width of the cape. Each cape section is provided with a perforated neck opening outline which is spaced from one of the rows and is connected thereto with a perforated slit outline.

10 Claims, 4 Drawing Figures

PACKAGED DISPOSABLE CHEMICAL CAPES

BACKGROUND AND FIELD OF THE INVENTION

The present invention relates to the field of accessories for hairdressing salons, beauty parlors or the like, and particularly, for packaged disposable chemical capes.

At present, to protect the clothing of customers during hairsetting, tinting and other procedures using chemicals, there are provided towels and bibs. One shampoo garment shown in U.S. Pat. No. 2,080,107 issued to S. J. Brandstein consists of a sheet which has at one end a neck receiving opening spaced from the edges of the material and connected by an elongated opening to the edge of the material. Other patents of interest are U.S. Pat. Nos. 2,016,079; 2,056,998; 2,289,526; 2,523,323; 2,544,487; 2,865,023; 3,031,676; 3,213,464 and 4,458,364.

SUMMARY OF THE INVENTION

This invention relates to packaged disposable chemical capes which are made from a long continuous strip of flexible material which is resistant to chemicals used in hair treatment and which is stored as a roll on a roller mounted on a wall. The strip is divided into a number of cape sections by perforated rows which are perpendicular to the edges of the strip and are spaced apart a distance equal to the length required of each cape. The width of the strip is the distance required for each cape. A perforated neck opening outline is provided in each cape section a selected distance from one of the perforated rows. A perforated slit outline extends from about the center of the neck opening outline to the closest perforated row.

The continuous strip is preferably mounted on a roller such as a roll of paper towels would be and is suspended from a bracket which is mounted on a wall or other convenient spot. In operation, the rolled strip is thus mounted on a roller support. When a disposable chemical cape is needed, the first cape section is formed from the strip by tearing along the appropriate perforated row, so that the cape section is separated from the rest of the cape sections. The next step is to tear open the perforated slit outline until it encounters the perforated neck opening outline. Next, a tear is made along the neck opening outline. Now the cape is ready for use by the beauty salon operator.

It is thus an object of this invention to provide packaged disposable chemical capes which are readily stored in an accessible manner. The required perforations are especially well located to facilitate converting the long strip into individual capes.

Other objects and a better understanding of the invention can be had from the following description taken in conjunction with the drawings.

DETAILED DESCRIPTION OF THE PREFERRED EMBODIMENT

Figure 2:
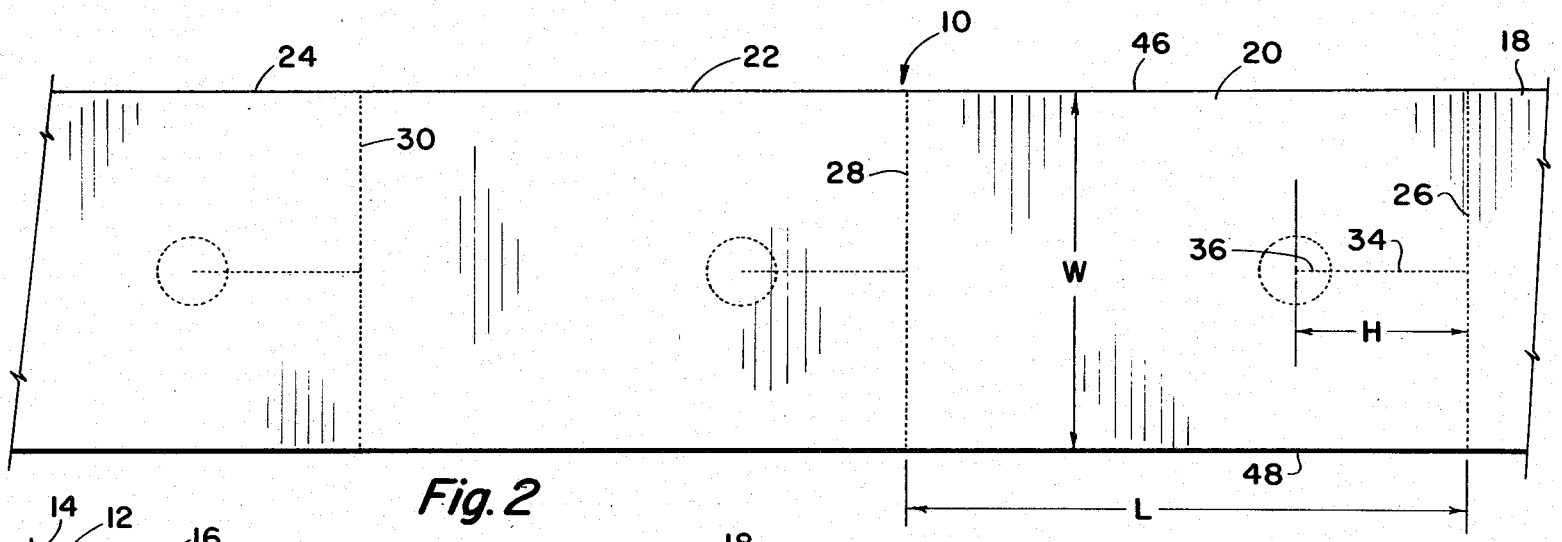
FIG. 2 shows perforations outlined for converting the strip to individual chemical capes.
Figure 1:
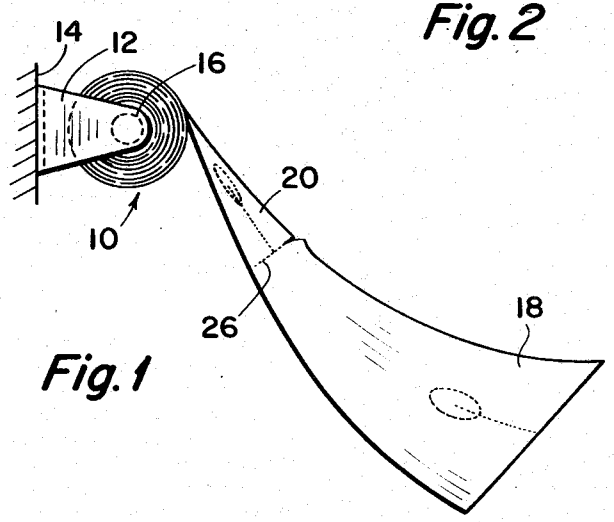
FIG. 1 is a view showing my packaged disposable chemical capes mounted on a roller.

Attention is first directed to FIG. 1 which shows a roll of chemical capes 10 mounted on roller 16 which is supported from bracket 12 which is attached to a wall or post 14, for example. Cape sections 18 and 20 are also illustrated. The cape sections are separated from each other by a perforated row 26 and each cape section is provided with an outline of a neck opening. In order to see this better, attention is directed to FIG. 2. As shown thereon are the cape sections 18, 20, 22 and 24 separated by perforated rows 26, 28 and 30 outlining cape sections 20, 22 and 24. The distance between rows 26 and 28 is designated L which is the desired length of a chemical cape and the distances between the edges 46 and 48 is designated W which is the width of the desired size of the disposable chemical cape.

These chemical capes are made of a continuous strip of material which is resistent to the chemicals normally used in a beauty salon for treating hair such as for dying, tinting and so forth. The material may be polyethlene, a polyvinyl acetate or chloride and should be made about as thin as possible to still give the protection. A thickness of about 1 mil is very well suitable for the purposes of this invention.

Cape section 20 is provided with a perforated neck opening outline 32 whose center is a distance H from the edge 26. Neck opening outline 32 typically has a 6 inch diameter and H is typically approximately 16 inches. The width of the cape section is typically about 36 inches and the length L is typically about 54 inches although I am not limited to those particular dimensions.

A perforated slit outline 32 extends from edge 26 to preferably about the center of neck opening outline 32.

Figure 3:
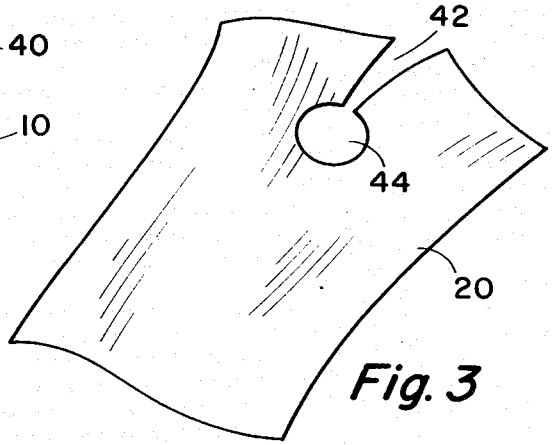
FIG. 3 illustrates the resulting cape complete with neck opening.

This packaging system has been found to be very convenient and the arrangement of the perforated outlines are quite easy to use. When I need a disposable chemical cape, I merely use the device shown in FIG. 1 by unrolling the device to the position approximately shown in FIG. 1 and at this time I tear along perforated row 26 and separate cape section 20 from the remaining part of the roll of chemical capes 10. I next part the cape along perforated slit outline 34 until it enters into the inside of perforated neck opening outline 32. It is highly advantageous and preferred that perforating slit outline 34 go to the approximate center of perforated neck opening 32. This permits one to tear along the neck opening outline 32 to make the neck opening. If the perforated slit outline 34 stopped at the circumference of the neck opening outline 32, it would be more difficult and not as convenient to tear along the neck opening perforation outline 32. After I have performed all these steps I then have an individual disposable chemical cape as shown in FIG. 3. Shown thereon is chemical cape 20 having neck 44 with slit 42. The cape is then ready for use.

Figure 4:
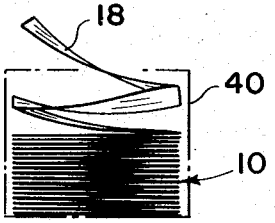
FIG. 4 illustrates my disposable chemical capes packaged in a container.

An alternate form of packaging these disposable chemical capes is shown in FIG. 4. A chemical cape strip 10 has been folded and place in box 40. When a new chemical cape is needed, I pull the end of cape section 18 up from the pack 10 and tear along the perforations just described above in regard to FIGS. 1 and 2.

While this invention has been described with a certain degree of particularity, it is manifest than many changes may be made in the details of construction in the arrangement of components without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed:

1. Packaged disposable chemical capes for use by operators in beauty salons which use chemicals in treating hair which comprises:

a continuous strip consisting of a flexible material resistent to said chemicals and impervious to water, said strip having a first and second edge and a first and second end;

a plurality of spaced apart perforated rows perpendicular to the edges of said strip defining cape sections, each said cape section having a perforated neck outline for a neck opening spaced from an adjacent row of perforations, a perforated slit outline extending to said neck outline from one of said rows nearest to said neck outline.

2. Chemical capes as defined in claim 1 in which said neck opening outline is a circle and is centered between the two edges.

3. Chemical capes as defined in claim 2 in which said strip is rolled into a roll for mounting on a roller.

4. Chemical capes as defined in claim 3 in which said slit outline extends into the center of said opening.

5. Chemical capes as defined in claim 4 in which said strips are folded into flat parallel portions and stored in a box.

6. Chemical capes as defined in claim 5 in which said strip is made of polyvinyl film 0.001 inches thick.

7. Packaged disposable chemical capes for use by operators in beauty salons which uses chemicals in treating hair which consists of:

a continuous strip of flexible material resistant to said chemicals and nonabsorbent to water, said strip having a first and second edge and a first and second end;

a plurality of spaced apart perforated rows perpendicular to the edges of said strip defining cape sections, and each section having a neck cut out and a slit extending from said neck opening extending to the nearest row of perforations.

8. A chemical cape as defined in claim 7 in which said neck opening outline is a circle and is centered between the two edges.

9. Chemical capes as defined in claim 8 in which said strips are folded into flat parallel portions and stored in a box.

10. Chemical capes as defined in claim 9 in which said strip is made of a polyvinyl film about 0.001 inches thick.

* * * * *